United States Patent [19]

Larsson

[11] 3,976,003

[45] Aug. 24, 1976

[54] PULP BALE PRESS FOR FORMING A BALE

[75] Inventor: Bo Lennart Henning Larsson, Karlstad, Sweden

[73] Assignee: Sunds Aktiebolag, Sundsvall, Sweden

[22] Filed: July 29, 1974

[21] Appl. No.: 492,749

[30] Foreign Application Priority Data

Aug. 9, 1973 Sweden ..... 7310896

[52] U.S. Cl. ..... 100/295; 100/3; 206/83.5; 214/152

[51] Int. Cl.[2] ..... B30B 15/06

[58] Field of Search ..... 100/295, 3, 132; 214/152; 206/83.5

[56] References Cited

UNITED STATES PATENTS

| | | | |
|---|---|---|---|
| 159,378 | 2/1875 | Baldwin | 100/3 |
| 206,658 | 8/1878 | Blossom | 100/295 |
| 1,960,548 | 5/1934 | Pfeiffer | 100/295 X |
| 3,650,120 | 3/1972 | Harza | 100/295 X |

*Primary Examiner*—Billy J. Wilhite

*Attorney, Agent, or Firm*—Stevens, Davis, Miller & Mosher

[57] ABSTRACT

A pulp bale press for forming the pulp bale including a first press table and a second press table between which the bale is pressed. One of the tables has protrusions for forming recesses in the bale, which recesses slope downwardly from an upper surface of the bale to lateral surfaces of the bale. The bale is held together by a wire or strap to which a lifting hook is applied to lift the bale. The wire or strap extends about the recesses resulting in a reduced lifting angle between portions of the wire or strap extending from the bale on either side to the hook, thereby limiting tension in the wire or strap.

4 Claims, 5 Drawing Figures

PULP BALE PRESS FOR FORMING A BALE

The present application discloses a method and a device for handling a load of fibrous material such as pulp bales or similar loads which are held together by wires or straps to which lifting hooks can be applied. More particularly, the invention has for its object in a simple and safe manner to limit the tensions in said wires or straps at the lifting of the bales and thereby to decrease the costs for the wiring or strapping of the load. The invention relates to a pulp bale press for forming the pulp bales to carry out this object.

In lifting wired loads of pulp bales the wire tension depends on the angle between the wire portions extending from the lifting hook or hooks to each side of the load, the vertical component of the tension being equal to the weight of the load. Thus, in order to achieve a small wire tension the lifting angle must be made small. At the lifting operation the wire is raised above the top side of the load to different degrees depending upon the degree to which the wire is pressed into the load and is drawn out by the hook. The raising of the wire, which decreases the lifting angle, must be limited or restricted, since it will partly remain during the lifting operation so that the keeping together of the load can be jeopardized during the further handling and at renewed lifting operations. However, it is possible even when the wire is raised only to a small degree to achieve a considerable decrease of the lifting angle by using two lifting hooks each applied to the wire as near as possible to one side of the load.

The handling of pulp bales according to the above is a technique well-known and used for a long time. In order to increase the capacity a plurality of bales are assembled and strapped into so called unit loads which are then placed in a row face to face under a yoke from which a plurality of hooks are suspended by chains or the like and by means of which all unit loads are lifted together. In such case it is necessary that inter alia the following conditions are fulfilled. The number and thickness of the wires must be chosen so that a certain security factor, usually 4, is obtained, calculated for the lifting angle obtained already at normal load. The yoke must not be broader than the load so that the latter can pass through the cargo-hatch of a freighter. The chains in which the lifting hooks are suspended should have a certain minimum length to facilitate the application of the hooks, and suitably a maximum length to minimize the distance between the yoke and the upper surface of the load. A method affording, in principle, optimal conditions, i.e. simple hooking and zero lifting angle is to apply clips to the wire at the upper edges of the load and to effect the hooking at said clips. However, this method is expensive and, moreover, it has a substantial disadvantage in that the wire is always raised at least to a certain extent so that the clips can sometimes get loose, the security factor then becoming insufficient for further lifting operations. Therefore, it has been shown to be more suitable to apply the hooks directly under the wire at the upper side of the bale where the wire is most easily accessible, and at a certain distance from the sides of the bale where the wire can easily be hooked. At lifting the hooks move outwardly towards the sides to a position of equilibrium. This method gives a fairly acceptable lifting angle. The latter is, however, far from optimal, partly owing to the abovementioned conditions relative to the breadth of the yoke and the length of the hook chain and partly to some extent owing to the fact that the position of equilibrium is influenced in the negative sense by the friction against and the deformation of the wire, this moreover resulting in the wire between the hooks becoming subjected to a higher tension than other parts of the wire.

According to the present application it has now been shown to be possible in a simple and operationally secure manner to reduce the lifting angle to a wholly acceptable value by making some changes to the shape of the load.

A method disclosed herein for handling a load of fibrous material tightly enclosed by a wiring or strapping material extending along an upper surface and two lateral surfaces of the load and adopted to be engaged by at least one hook of a device for lifting said load by means of said wiring or strapping material is characterized in that said load, before the lifting thereof, is provided with a recess, opening outwardly, for the wiring or strapping material at each of the upper lateral portions of the load for reducing the lifting angle between the wiring or strapping material portions extending from the load to said at least one hook.

Fundamentally, the present apparatus resides in the realization that minor recesses at the upper edges of the load provide an effect which is equivalent to increased raising of the wire above the upper surface of the load without, however, jeopardizing the continued keeping together of the load. The recesses can be obtained by a cutting or a hard pressing or moulding operation.

Preferably, said recesses are limited to the region of the load where said wiring or strapping material extends. The size and shape of the recesses can be such that said lifting angle becomes less than about 100° suitably between about 70° and about 90° and preferably less than about 80°. In a preferred embodiment each of the recesses have a bottom surface sloping downwardly from the upper surface of the load to one lateral surface thereof.

According to another aspect of the present disclosure there is provided a bale of cellulose pulp, especially so called flash-dried pulp, said bale being characterized in that it is provided with a recess at one or both of the upper lateral portions thereof as described.

According to a further aspect of the present disclosure, the invention relates to an arrangement in a pulp bale press said arrangement being characterized in that one of the press tables of said press is provided, at the side thereof facing the other press table, with protrusions capable of forming a recess at one or both of the upper lateral portions of the bale at the bale pressing operation.

The invention will hereinafter be more fully described with reference to the accompanying drawings in which FIG. 1 schematically shows a wired load A1 and load lifting means as seen in a vertical mid-section.

Figure 1:
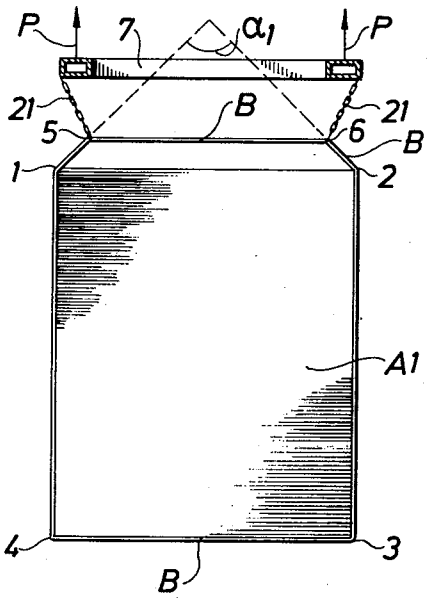

FIG. 1 shows a conventional load A1 which can, for instance, consist of cellulose pulp. The load is substantially rectangular in a vertical cross section and is rectangular also in a horizontal cross section. In the case of cellulose pulp the load can contain, for instance, two stacks of bales, each stack comprising three or four bales. The load is tightly enclosed and kept together by a wiring material B usually consisting of several parallel wires. As well known in the art this type of material can be substituted by straps.

The wiring material B extends along the bottom side and the vertical lateral sides of the load and around the four corner edges 1, 2, 3 and 4 thereof. From a load lifting yoke or frame 7 suspended by some means P from a crane or other lifting apparatus two conventional hooks, indicated at 5 and 6 but not shown in detail, are suspended by chains 21, which may be composed of shackles. The chains 21 are suspended at the yoke from points spaced from each other a distance approximately equal to the distance between the lateral sides 1–4 and 2–3 of the load. The length of the chains 21 is usually considerably less than the distance between the points of suspension of the chains. Before the lifting operation the hooks are applied under the wiring material extending between the upper corner edges 1 and 2 of the load. At the lifting operation the hooks slide along the wiring material until they reach their position of equilibrium shown in FIG. 1. The lifting angle $\alpha$ between the wire parts extending from the corner edges 1 and 2 to the hooks 5 and 6 respectively, varies with the extent to which the hooks slide towards the corner edges 1 and 2, respectively and with the extent to which the part of the wire extending between the hooks 5 and 6 is raised above the upper horizontal surface of the load.

Figure 2:
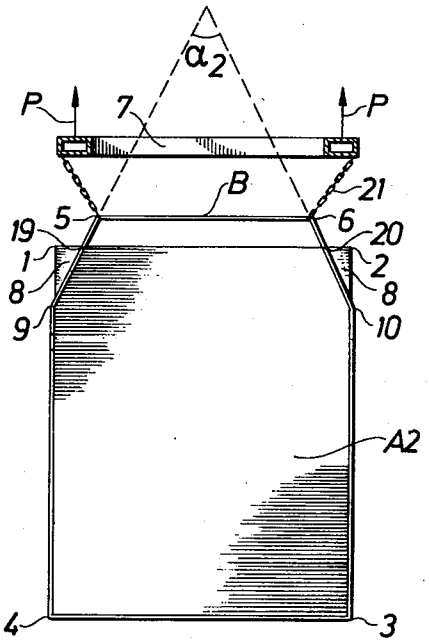
FIG. 2 shows in a manner corresponding to FIG. 1 a load A2 and lifting means according to one embodiment of the present apparatus and load product.

According to FIG. 2 which illustrates an embodiment of the load and apparatus a load A2 is enclosed by means of a wiring material B and is lifted in a similar manner as according to FIG. 1. However, the load has been provided with a recess 8 centrally located at each of the upper lateral portions thereof near the corner edges 1 and 2, said recesses accommodating the wiring material at this place. The bottom surface of such a recess is substantially plane and is sloping outwardly from a line 19 and 20, respectively, at the upper side of the load a certain distance from the pertaining vertical side thereof, to a line 9 and 10, respectively at one vertical side of the load a certain distance beneath the horizontal upper side of the load, this resulting in a lifting angle $\alpha 2$ as indicated which is considerably less than the angle $\alpha 1$ according to FIG. 1.

Figure 3:
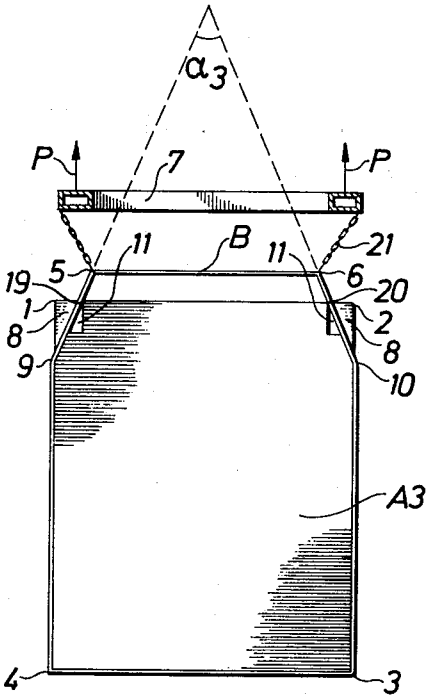
FIG. 3 shows in a similar manner as FIG. 2 a load A3 and lifting means according to another embodiment of the load product and apparatus.

According to FIG. 3 illustrating another embodiment of the load product and apparatus the bottom surface of each recess 8 is provided with a further recess 11 facilitating the application of the corresponding hook of the lifting yoke.

The effect of the recesses according to the invention will now be explained in more detail.

If a load having a shape substantially as shown in FIG. 1 consists of a very soft or resilient material the wiring material would in some cases be able to create a small recess of its own at each of the upper corner edges 1 and 2 when the lifting is started after the hooks have been applied under the wiring material as described, but such recesses are often small, irregular and uncontrollable.

If the load as shown in FIG. 1 consists of a relatively hard material, for instance pressed pulp, especially bales of so called flash-dried pulp, i.e. pulp dried in a comminuted state in a stream of drying air and thereafter blown into a press and pressed into bales consisting of superimposed flakes of dried pulp, the wiring material cannot form mentionable recesses of its own as described above, and during the lifting operation the wiring material will therefore extend from the hooks 5 and 6 to the upper corner edges 1 and 2 of the load as indicated in FIG. 1, this resulting in a comparatively large lifting angle $\alpha 1$ as described.

In the embodiment illustrated in FIGS. 2 and 3 the lines 1 and 2 of the bale from which the wiring material extends to the hooks in FIG. 1 have been substituted by the lines 9 and 10, respectively, this resulting in the lifting angles $\alpha 2$, $\alpha 3$ being considerably reduced, although the possibility of the hooks sliding away from each other is somewhat less.

In the embodiment illustrated in FIG. 3 the hooks after the application thereof to the wiring material in the recesses 11 will be moved towards each other to their points of equilibrium during the lifting operation instead of being moved away from each other as according to FIGS. 1 and 2 so that the distance between the hooks 5 and 6 will be somewhat larger in the case of FIG. 3 than in the case of FIG. 2 owing to the braking frictional and deformation forces acting upon the hooks and the wiring material. Moreover, the tension of the wiring material between the hooks will be less than the tension of the wiring material outside the hooks, whereas in FIGS. 1 and 2 the tension of the wiring material between the hooks will become larger than the tension outside the hooks which is a disadvantage, since the wiring material must be dimensioned accordingly and not only for taking up the tension of the wiring material outside the hooks.

The position of the lines 9 and 10 at the vertical sides of the load, said lines forming the base of the lifting angle, can be chosen so that the lifting angles $\alpha 2$ and $\alpha 3$ become less than about 100°. Said angles can suitably be between 70° and 90° and should preferably be less than 80°. The vertical distance between each line 9,10 and the horizontal top surface of the load can be more than about 1/15 (one fifteenth), for instance from about 1/5 to about 1/10 of the breadth of the load, i.e. the distance between the lines 1 and 2.

In the arrangements according to all of the FIGS. 1 to 3 the weight of the load is taken up by the sum of the vertical components of the tension in the two wire portions extending from the hooks 5 and 6 to the load. As the lifting angles $\alpha 2$ and $\alpha 3$ in FIGS. 2 and 3 are considerably less than the corresponding angle $\alpha 1$ in FIG. 1, it follows that the tension in said portions of the wire is reduced correspondingly, so that it no longer becomes considerably greater than said vertical component taking up the weight of the load, as is the case in the conventional method illustrated in FIG. 1.

The technical effect of the load product and apparatus has been tested under practical conditions in handling bales of flash-dried cellulose pulp. The bales, each weighing about 200 kg, are fed to a common high-pressure press and are packaged by means of paper and wire. The bales are thereafter assembled into unit loads containing $2 \times 3 = 6$ bales which unit loads are wired together by means of a suitable number of wire loops each provided with a separate knot. The wire tension and the degree to which the upper horizontal portion of the wires are raised at the subsequent lifting as well as the lifting angle will be determined to a high degree by the compression in the high-pressure "thousand tons" press used, the resilient expansion of the bales and the time for such expansion.

It has shown to be suitable after the bale pressing operation to provide for a buffer time of about 1200 *s* between pressing and final wiring (units and nominations according to International Standard, IS). The dimensions of the horizontal press surface of each bale were 600 × 900 mm. For lifting the unit load, 1200 kg, a force of about 12 kN is required which is equally distributed between the wire portions extending from the two vertical sides of the load. The breadth of the load corresponding to the distance between lines 1 and 2 in FIG. 1 was 1200 mm and the length of the hook chain between the wire and the lifting yoke was 325 mm. When lifting in a conventional manner similarly as described in connection with FIG. 1 the lifting angle obtained was 120°. Consequently, the wire tension in the wire portion between each of the hooks and the load was 12 kN. With a security factor of 4 and not accounting for the somewhat increased tension in the wire portion between the hooks the wire is required to take a traction load of $4 \times 12 = 48$ kN. The wire material used had a tensile strength to rupture of 1.15 kN/mm$^2$. In order that the number of wire loops shall not be excessive, wires having a diameter of 3 mm and thus a tensile strength to rupture of 8 kN per wire was used. Thus, the required number of wire loops was six; steel wires were used.

For testing the lifting technique the bales were provided with recesses 8 as described. The vertical distance between each of the lower end lines 9 and 10 of the recesses and the top surface of the load was 100 mm, and this proved to be effective for reducing the lifting angle to a quite sufficient degree. A reduction of the lifting angle to 90° by means of such recesses results in a reduction of the required tension in the wire portions between the hooks and each of the sides of the load to 8.5 kN which is only about 40 % more than the vertical component required for taking up the unit load. With a security factor of 4 each of said wire portions shall be able to take a load of $4 \times 8.5 = 34$ kN. This requires only five loops of wire having a diameter of only 2.75 mm.

Figure 4:
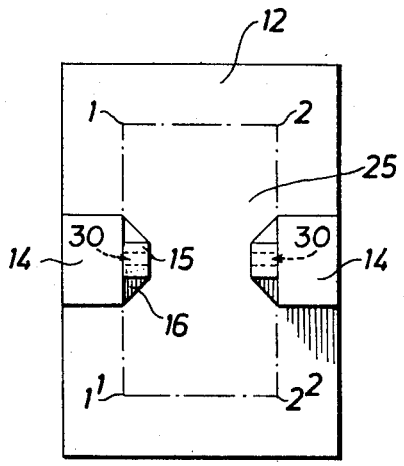
FIGS. 4 and 5 show in plane view and side elevation, respectively, an embodiment of an arrangement in a pulp bale press of the present invention for carrying out the disclosed method.
Figure 5:
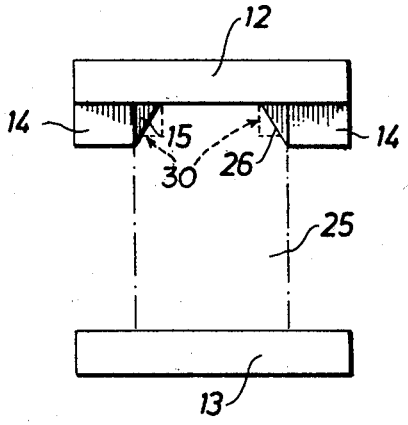

For providing the bales with recesses, according to the present invention various methods can be used. It has shown to be suitable, especially in the case of bales of flash-dried pulp, to provide one of the press tables of a high pressure press, preferably the upper one, with recess-forming protrusions or moulds which are pressed into each separate bale. FIGS. 4 and 5 show an embodiment of an arrangement in a bale press for this purpose. An upper press table 12 and a lower press table 13 form therebetween a space, indicated by 25 and defined between dotted lines and corner edges 1, 2, 1' and 2' for accommodating the bale. In FIG. 4 the upper press table is shown from below and FIG. 5 shows both press tables from one end thereof. At the underside of the upper press table and half-way between the ends of the table two protrusions 14 are provided each having a portion extending into the space 25 and consisting of a central part 15 and two wing parts 16. Part 15 defines a plane surface 26 sloping outwardly from the underside of the table to one side of the space 25 and extending sidewise in the direction of length of the press table 12. Each of the wing parts 16 defines a plane surface sloping from the underside of table 12 and forming a blunt angle with the plane surface 25 defined by part 15.

At the bale pressing operation the portions 15 and 16 of the protrusions 14 are pressed into the upper lateral portions of the bale thus forming the recesses 8 indicated in FIG. 2 the surface 25 defining the bottom surface of said recesses.

The additional recesses 11 according to FIG. 3 can be formed by modifying the portions 15 and 16 of the protrusions 14 accordingly, for instance by providing the portions 15 with extra extensions 30 corresponding in shape to the recesses 11 and shown in dotted lines in FIGS. 4 and 5.

The protrusions 14 are shown in FIGS. 4 and 5 as having a limited extension in the direction of length of the press table 12 but the protrusions can have a length so as to form a recess along the entire length of each side of the bale. However, since the recesses fulfill their purpose only at the regions where the wiring material is applied and since small recesses are easier to form than large ones the length in the direction 1—1' of the portion 15 forming the surface 26 can be limited so as not to be greater than about 1/5 and preferably not greater than about 1/10 of the length 1—1' of the bale.

The embodiments shown and described can be modified in various manner within the scope of the invention. Thus, for instance, the bottom surface of the recesses 8 can be curved instead of being plane or can have any other suitable shape and the manner in which the recesses are formed can vary according to the circumstances. Sometimes forming of the recesses by removal of a corresponding amount of material from the bale can be permitted, but forming directly in connection with a bale pressing operation thus avoiding waste of pulp material is to be preferred.

I claim:

1. A pulp bale press for forming a pulp bale having an upper surface, two lateral surfaces and recesses which slope downwardly from the upper surface to the lateral surfaces, comprising:

a. a first press table; and b. a second press table, said first and second press tables forming the bale between said tables, said first table having a surface facing said second press table and including protrusions for forming the recesses, said protrusions each including a portion extending into a space between said first and second tables accommodating the bale, and having a substantially flat central part sloping outwardly from said surface of said first table to one side of said space and extending sideways in the direction of the edges of said first table.

2. A pulp bale press according to claim 1 where said portion further includes wing parts on either side of said central part, each of said wing parts defining a surface sloping from said surface of said first table and forming an angle with a surface of said central part.

3. A pulp bale press according to claim 2 wherein said angle is a blunt angle.

4. A press for producing bales of fibrous material such as pulp bales, said bales having a horizontal surface and two adjacent lateral surfaces, and strapping material to form a tightly enclosed load including a plurality of bales, said strapping material being engageable by at least one hook of a device for lifting said load by means of said strapping material, said press comprising:

two press tables between which a bale is formed, one of said press tables having protrusions shaped to form outwardly opening recesses in the bale between said horizontal surface and the adjacent lateral surfaces of the bale, said recesses being shaped and positioned to substantially reduce the lifting angle between strapping material portions extending from the load to said at least one hook, and in which the protrusions have extensions shaped to form additional recesses extending beneath the strapping material for facilitating the application of said hook to the strapping material.

* * * * *